US005586594A

United States Patent [19]

Shapoff

[11] Patent Number: 5,586,594

[45] Date of Patent: Dec. 24, 1996

[54] INFLATABLE WALL

[76] Inventor: Stanley N. Shapoff, 816 Coronado Ct., San Diego, Calif. 92109

[21] Appl. No.: 559,986

[22] Filed: Nov. 17, 1995

[51] Int. Cl.[6] ..... A47G 5/00

[52] U.S. Cl. ..... 160/135; 40/605; 40/610; 52/2.23; 52/205; 52/239

[58] Field of Search ..... 160/135, 351, 160/236, DIG. 8; 52/220.3, 2.23, 205, 239, 36.1; 40/605, 610, 736, 624

[56] References Cited

U.S. PATENT DOCUMENTS

| | | | |
|---|---|---|---|
| 3,227,169 | 1/1966 | Fischer | 52/2.23 |
| 3,526,199 | 9/1970 | Keats | 116/63 |
| 3,686,782 | 8/1972 | Erickson et al. | 40/152 |
| 3,729,847 | 5/1973 | Chandos | 40/125 F |
| 4,000,585 | 1/1977 | Denaro | 52/2 |
| 4,040,210 | 7/1977 | Land | 52/2.12 |
| 4,171,595 | 10/1979 | Tucker | 52/2 |
| 4,179,832 | 12/1979 | Lemelson | 40/540 |
| 4,255,907 | 1/1981 | Lightell | 52/2.12 |
| 4,296,960 | 10/1981 | Winchester | 296/167 |
| 4,369,591 | 1/1983 | Vicino | 40/610 |
| 4,776,121 | 10/1988 | Vicino | 40/610 |
| 4,995,186 | 2/1991 | Collie | 40/591 |

*Primary Examiner*—David M. Purol
*Attorney, Agent, or Firm*—Calif Kip Tervo

[57] ABSTRACT

An inflatable wall generally comprises a wall panel including a pliable skin defining an inflatable enclosure and a hinge. Internal I-beams retain the front and rear of the wall panel as spaced vertical planes. The hinge has a vertical axis and is attached to the wall panel first end for supporting the wall in an upright position by hinged attachment to an adjacent wall. The enclosure includes a window box and a window for holding displays or the like. A raceway within the enclosure allows for passage of electrical wiring to displays within the windows. In an alternate exemplary embodiment, two inflatable walls are permanently joined by a flexible hinge having a supplemental hinge on each side, each for hinged attachment of another wall.

15 Claims, 2 Drawing Sheets

FIG. 7
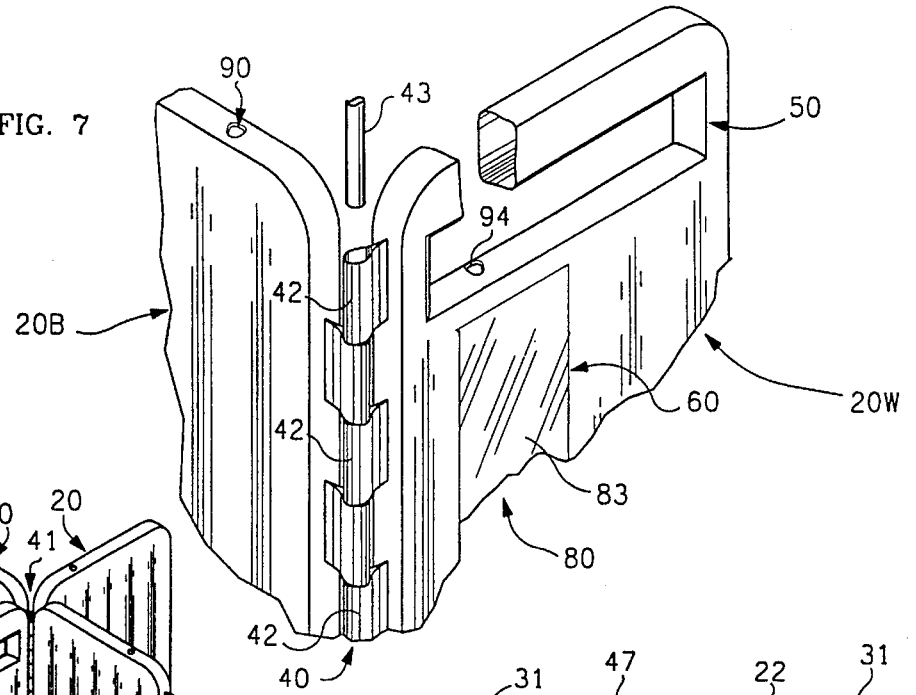
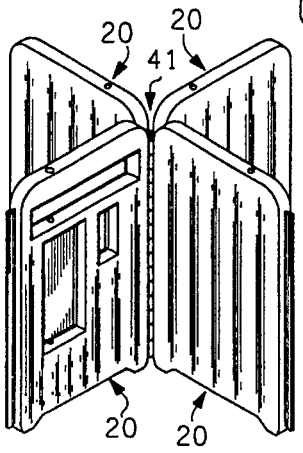
FIG. 8
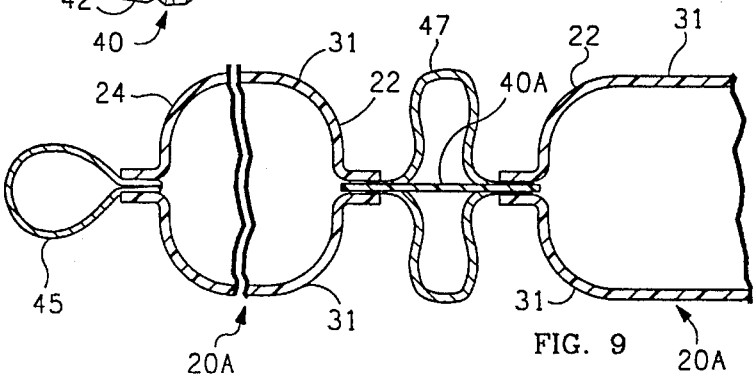
FIG. 9
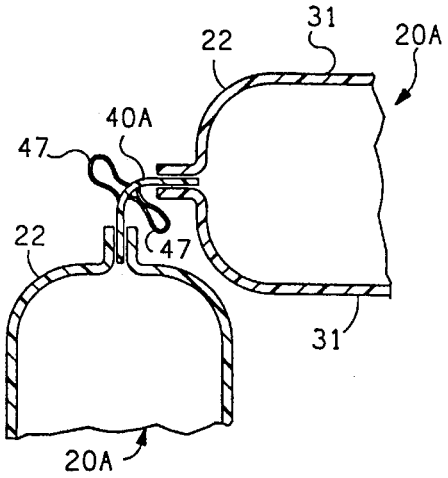
FIG. 10
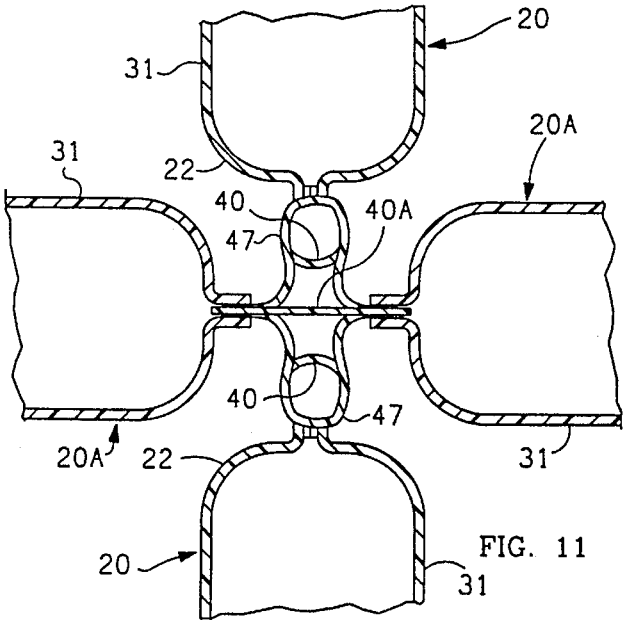
FIG. 11

INFLATABLE WALL

BACKGROUND OF THE INVENTION

1. Field of the Invention

This invention relates to inflatable furniture systems and more particularly to an inflatable wall and wall structure particularly designed for use in trade show, visual merchandising and special events.

2. Description of the Prior Art

Display booths in various forms are used at trade show, fairs and conventions to establish a presence and present the product.

Conventional display booths are of rigid construction and are difficult and expensive to transport to the site. Additionally, there are associated set-up and dismantling costs.

Therefore, there has been a need for an inflatable display wall that is collapsible, easily transportable, affordable, lightweight and easy to erect and use. It is further desirable if the display wall provides for presentation of electric display lighting and signage.

SUMMARY OF THE INVENTION

According to the invention, an inflatable wall generally comprises a wall panel including a pliable skin defining an inflatable enclosure and a hinge. The inflatable enclosure includes a first sheet generally defining a first side of the enclosure, a second sheet generally defining a second side of the enclosure and internal web means within the enclosure joining the inner side of the first sheet to the inner side of the second sheet such that, when the enclosure is inflated, the first sheet and the second sheet are substantially parallel spaced vertical planes, the enclosure has a periphery and the wall panel has a periphery including a bottom for placement on a support surface, a top and first and second ends. The hinge has a vertical axis and is attached to the wall panel first end for supporting the wall in an upright position by hinged attachment to an adjacent wall.

The enclosure includes a window box and a window for holding displays or the like. The window box comprises an orifice in the first sheet and gussets forming a seal between the periphery of the orifice in the first sheet and the inner side of the second sheet. The window comprises orifices in both sheets and a gusset forming a seal between the periphery of the orifices. A raceway within the enclosure allows for passage of electrical wiring to displays within the windows. An electrical display is disposed in the window with its electrical cord disposed through the raceway.

In an alternate exemplary embodiment, two inflatable walls are permanently joined by a flexible living hinge having a supplemental hinge on each side, each for hinged attachment of another wall.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 7 is a perspective view, partially cut away, of the top rear of FIG. 1 showing a preferred embodiment of the joining hinge.

FIG. 8 is a reduced perspective view of four walls joined together to form a structure.

FIG. 9 is a horizontal sectional view of an alternate embodiment of a joining hinge linearly joining two walls.

FIG. 10 is a reduced horizontal sectional view of the alternate hinge of FIG. 9 joining two walls at right angles.

FIG. 11 is a view of the alternate hinge of FIG. 9 joining two walls linearly and two additional walls at right angles to form a structure as seen in FIG. 8.

DETAILED DESCRIPTION OF THE INVENTION

Figure 1:
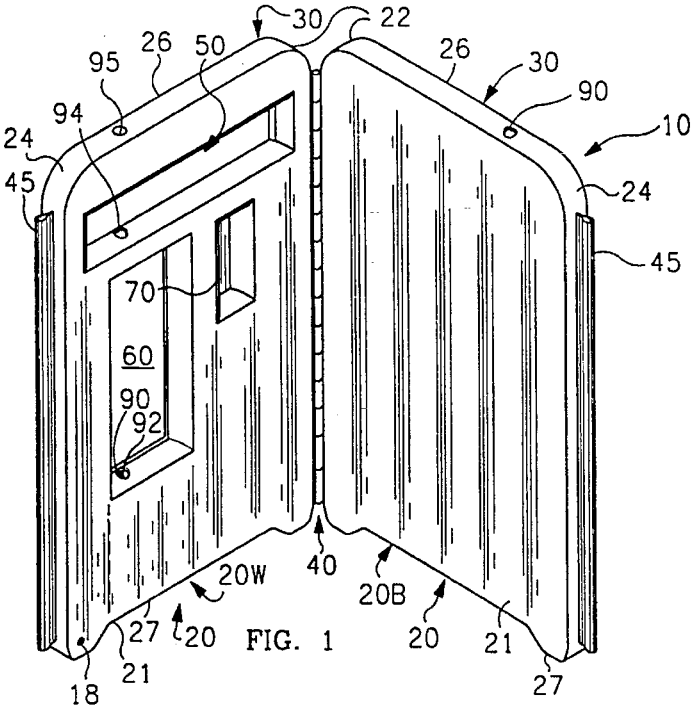
FIG. 1 is a perspective view of two preferred embodiments of the inflatable wall of the invention joined to form a structure.

With reference now to the drawings, FIG. 1 is a perspective view of a preferred embodiment of the inflatable wall structure, denoted generally as 10, of the invention. FIG. 7 is a perspective view, partially cut away, of the top rear of FIG. 1 showing a preferred embodiment of the joining hinge 40. Inflatable wall structure 10 generally includes a plurality of walls, denoted generally as 20 and specifically as 20W, 20B. Each wall 20 includes a wall panel 21 and hinge means, such as hinge 40 attached to first end 22 of wall panel 21. Hinge 40 has a vertical axis and is hingedly attached to a mating hinge on an adjacent wall for supporting wall structure 10 in an upright position. Preferably, each wall 20 includes additional hinge means, such as hinge loop 45, on wall panel second end 24, for hinged attachment of additional panels 20. In the embodiment shown, wall 20W includes a pair of windows 50, 60 a shadow box 70, and electrical raceways 95. Valve 18 is used to inject air into wall 20W.

Figure 2:
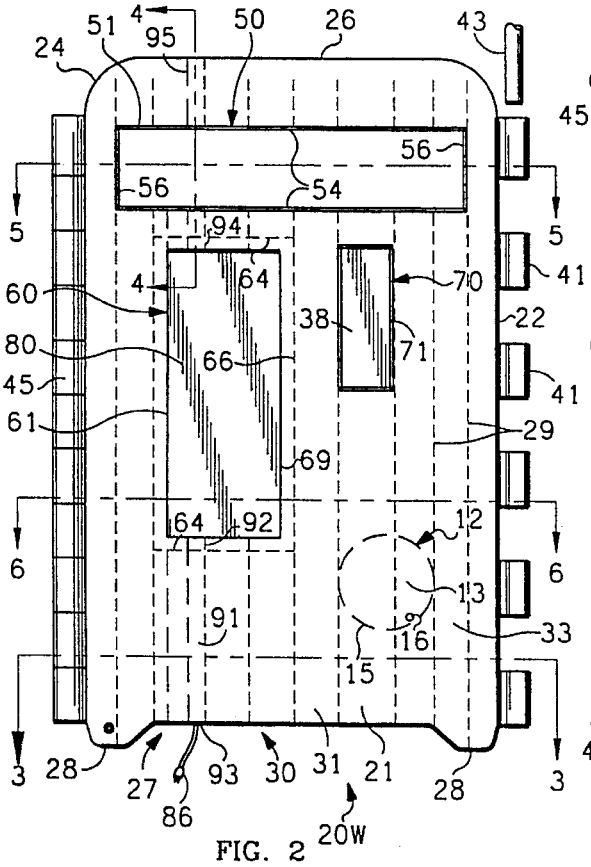
FIG. 2 is an enlarged front elevation view of a wall of FIG. 1 further including a display sign.
Figure 3:
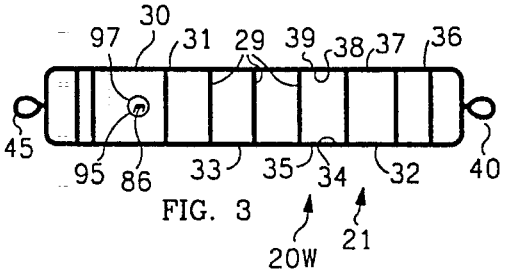
FIG. 3 is a horizontal sectional view of the wall taken on line 3—3 of FIG. 2.

Turning to FIGS. 2 and 3, FIG. 2 is an enlarged front elevation view of wall 20W of FIG. 1 further including a display sign 80. FIG. 3 is a horizontal sectional view of wall 20W taken on line 3—3 of FIG. 2.

Wall 20W includes a wall panel 21 having a periphery including a bottom 27 for placement on a support surface, a top 26, first and second ends 22, 24 and an inflatable enclosure 30 enclosed by pliable skin 31. Skin 31 may be any suitable pliable inflatable material and preferably is pin-hole free PVC plastic which may be flat, embossed and/or have a cloth face surface. A first sheet 33 of skin 31 generally defines a first side 32 of enclosure 30. First sheet 33 has an inner side 34 and an outer side 35. A second sheet 37 of skin 31 generally defines a second side 36 of enclosure 30. Second sheet 37 has an inner side 38 and an outer side 39.

Internal web means, such as I-beams 29, within enclosure 30, join inner side 34 of first sheet 33 to inner side 38 of second sheet 37 such that, when enclosure 30 is inflated, first sheet 33 and second sheet 37 are substantially parallel spaced vertical planes. I-beams 29 may be any suitable material, but preferably are pinhole free PVC. In the preferred embodiment, I-beams 29 are welded to first and second sheets 33,37 and run vertically. So that inflation air can freely fill enclosure 30, air passageways are provided around the ends of I-beams 29. I-beams 29 alternatively may be horizontal.

Preferably, the bottom 27 of wall panel 21 is shaped to include projections, such as legs 28, for holding the major portion of wall panel 21 a slight distance off a support floor so as to facilitate the running of cables under wall panel 21 and to aid in cleaning the floor under wall panel 21.

Hinge 40, attached to wall panel first end 22, has a vertical hinge axis. Preferably, hinge 40 is made of loops, as shown, of flexible material or may be a continuous loop that can be cut into a plurality of separate hinges 41, so as to be attached, such as by pin 43, to a similarly constructed but mating hinge on adjacent wall 20B for supporting wall structure 10 in an upright position. Pin 43, shown partially cut away, is preferably a plastic pipe, such as of PVC, or other any suitable material. Preferably, pin 43 is comprised of one or more sections so as to be collapsible for transport. Preferably, hinge 40 is disposed the height or nearly the height of wall panel 21 such that, when joined to a mating hinge, the hinge functions as a continuation of walls 20 in that it is a continuous barrier. Attached walls 20 can rotate about hinge 40 to an angle relative to one another such that they support one another in an upright position. Hinge 40 allows relative rotation of greater than ninety degrees in either direction.

Hinge loop 45 on wall panel second end 24 preferably is a loop of material having a vertical axis which can be left as a decorative end to wall panel 24 or can be cut into a hinge similar to hinge 40 for attachment of additional walls 20.

Figure 4:
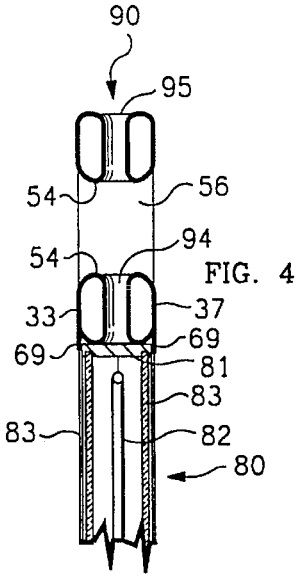
FIG. 4 is a vertical sectional view of the wall taken on line 4—4 of FIG. 2.
Figure 5:
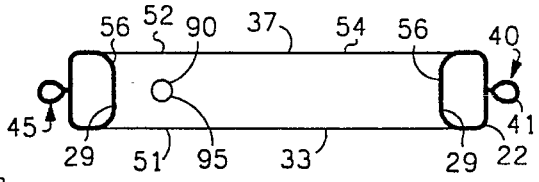
FIG. 5 is a horizontal sectional view of the wall taken on line 5—5 of FIG. 2.

Inflated enclosure 30 includes windows 50, 60 and shadow box 70. Window 50 is best described with reference to FIGS. 2, 4, and 5. FIG. 4 is a vertical sectional view of wall 20W taken through window 50 on line 4—4 of FIG. 2. FIG. 5 is a horizontal sectional view of wall 20W taken through window 50 on line 5—5 of FIG. 2. Window 50 comprises an orifice 51 in first sheet 33 located horizontally across from an orifice 52 in second sheet 37 and gusset means, such as a gusset or gussets, such as vertical gussets 56 and horizontal gussets 54, forming a seal between the periphery of orifice 51 and periphery of orifice 52. Preferably, one set of gussets, in this example vertical gussets 56, are formed by existing I-beams so that only the other set of gussets, in this case horizontal gussets 54, need be added to the basic enclosure structure to form window 50.

Framed window 60 is similar to window 50 in that it comprises an orifice 61 in first sheet 33 located horizontally across from an orifice 62 in second sheet 37. However, gusset means, such as a gusset or gussets, such as vertical gussets 66 and horizontal gussets 64, forms a seal between inner side 34 of first sheet 33 and inner side 38 of second sheet 37 near the periphery of orifices 61, 62 but sufficiently distanced from the peripheries such that sheet material between the seal and the periphery defines a frame 69. Frame 69 helps physically hold signage in window 60 and is an aesthetic cover for the joined of the periphery of sign 80 and window 60. Preferably, one set of gussets, in this example vertical gussets 66, are formed by I-beams 29 of the basic enclosure structure so that only the other set of gussets, in this case horizontal gussets 64, need be added to form window 50. Frame 69 may include hook/loop fasteners or magnetic fasteners on the inner side or outer side to hold signage.

Window box 70 is similar to window 50 except that there is only one sheet orifice 71, such as in first sheet 33, and gusset means forms a seal between the periphery of orifice 71 and inner side 38 of second sheet 37. Thus, signage placed in window box 70 is visible from only one side of wall structure 10. Optionally, window box 70 may be framed also in a manner described above.

A raceway 90 is included in enclosure 30 for furnishing electrical power to electrical devices, such as signage and lights. Raceway 90 is comprised of several portions. Lower raceway 91 includes a gusset orifice 92 in horizontal window gusset 64 and a peripheral orifice 93 in enclosure 30 near the periphery of enclosure 30 and wall means, such as tube 97 forming a seal between the periphery of gusset orifice 91 and the periphery of peripheral orifice 93 so as to preserve the integrity of enclosure 30. Tube 97 may be made of pliable PVC plastic or other suitable material. Raceway 90 includes middle portion 94 and upper portion 95 that are similarly constructed such that electrical wires may be passed within enclosure 30 to signage in windows and window boxes and may be passed entirely through enclosure 30 to overhead lighting or the like. Although only one raceway 90 is shown, more raceways may be added as desired for electrical transmission.

Figure 6:
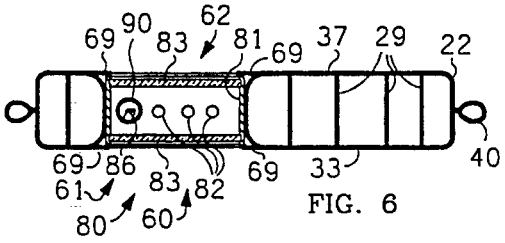
FIG. 6 is a horizontal sectional view of the wall taken on line 6—6 of FIG. 2.

As best seen in FIGS. 2 and 6, an electrical display, such as sign 80, is located in window 60. FIG. 6 is a horizontal sectional view of wall 20W taken through sign 80 on line 6—6 of FIG. 2. Sign 80 is a typical display sign including a peripheral support frame 81, lighting means, such as a plurality of electrical bulbs 82, and translucent display panels 83. An electrical cord 86, disposed through lower raceway 91 powers sign 80. Lighted display panels 83 can be seen from either side of wall 20. Similar signage may be placed in window 50 and shadow box 70.

Returning to FIG. 2, enclosure 30 includes a user-selective or potential display window, denoted generally as 12, that appears as a standard part of the flat face of wall panel 20 but that an end user may convert to a shadow box or window. Potential window 12 comprises a potential window area, such as circular window area 13, on first sheet 33, a potential window area, not shown, on second sheet 37 and gusset means, such as circular gusset 15, forming a seal between the periphery of potential window area 13 on inner side of first sheet 33 and the periphery of the potential window area on said inner side of second sheet 73. Ordinarily, the potential window areas would be similar and horizontally opposed. In this manner, the volume between the potential window areas is sealed off from the remainder of enclosure 30. Vent means, such as small orifice 16, through potential window area 13 allows ambient air to enter and escape the sealed-off volume during inflation and deflation of wall 20. To make a shadow box or window, the user cuts the window area out of first sheet 33 and/or second sheet 37. Wall 20 may contain a plurality of potential windows 12.

FIG. 8 is a reduced perspective view of four walls 20 joined together to form a structure. A sufficient number of separate hinge loops 41 may be turned to the side such that mating side panel may be joined to a common hinge.

FIGS. 9–11 illustrate an alternate preferred embodiment of a joining hinge 40A. FIG. 9 is a horizontal sectional view of an alternate embodiment of a joining hinge 40A linearly joining two walls 20A, shown almost entirely cut away with just the ends remaining. FIG. 10 is a reduced horizontal sectional view of alternate hinge 40A of FIG. 9 joining two walls 20A at right angles to form a structure similar to FIG. 1. FIG. 11 is a view of alternate hinge 40A of FIG. 9 joining linearly two walls and joining at right angles two additional walls to form a structure similar to that of FIG. 8.

Walls 20A are joined by hinge 40A having a vertical axis. 40A is made of flexible material such as flat, embossed and/or cloth faced PVC hingedly attaching first ends 22 of walls 20A such that walls 20A may be positioned non-linearly to one another, as shown in FIG. 10, so as to support one another to form a wall having a front and a rear. Supplemental hinge means, such as supplemental hinge loop 47 having a vertical axis, is connected to walls 20A adjacent hinge 47. Supplemental hinge loop 47 is similar to the hinge loops previously described and can be cut and used as desired to form a plurality of hinge loops for attachment of mating walls as shown in FIG. 11. A pair of supplemental hinge loops 47 connected to walls 20A adjacent hinge 40A, one on the front and one on the rear, each may by used for hinged attachment of another wall 20 to form a structure similar to FIG. 8.

A walls 20 as described typically weighs under ten pounds. A four wall 10'×10' booth weighs about thirty-five pounds and can fold into a carrying bag that fits into the trunk of a car.

Having described the invention, it can be seen that it provides a very convenient inflatable display wall that is collapsible, easily transportable, light-weight and easy erect and use. Further, the display wall provides for presentation of electric display lighting and signage and electric wire management completely within the confines of the inflatable enclosure.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An inflatable wall comprising:

a wall panel including:

a pliable skin defining an inflatable enclosure; said skin including:

a first sheet generally defining a first side of said enclosure; said first sheet having an inner side and an outer side; and a second sheet generally defining a second side of said enclosure; said second sheet having an inner side and an outer side;

internal web means within said enclosure joining said inner side of said first sheet to said inner side of said second sheet such that, when said enclosure is inflated, said first sheet and said second sheet are substantially parallel spaced vertical planes, said enclosure has a periphery and said wall panel has a periphery including a bottom for placement on a support surface, a top and first and second ends; and hinge means attached to said wall first end; said hinge means having a vertical axis; said hinge means for supporting said wall in an upright position by hinged attachment to an adjacent wall.

2. The inflatable wall of claim 1:

said enclosure including:

a window box comprising:

an orifice in said first sheet; and gusset means forming a seal between the periphery of said orifice in said first sheet and said inner side of said second sheet.

3. The inflatable wall of claim 2:

said enclosure including:

a raceway comprising:

a gusset orifice in said gusset means;

a peripheral orifice in said enclosure near the periphery of said enclosure; and wall means forming a seal between the periphery of said gusset orifice and the periphery of said peripheral orifice.

4. The inflatable wall of claim 3 further including:

an electrical display in said window; and a electrical cord disposed through said raceway and connected to said electrical display for powering said display.

5. The inflatable wall of claim 1:

said enclosure including:

a framed window box comprising:

an orifice in said first sheet; and gusset means forming a seal between said inner side of said second sheet and said inner side of said first sheet near the periphery of said orifice in said first sheet but sufficiently distanced from the periphery such that said sheet between the seal and the periphery defines a frame.

6. The inflatable wall of claim 1:

said enclosure including:

a window comprising:

an orifice in said first sheet;

an orifice in said second sheet adjacent said orifice in said first sheet; and gusset means forming a seal between the periphery of said orifice in said first sheet and the periphery of said orifice in said second sheet.

7. The inflatable wall of claim 6:

said enclosure including:

a raceway comprising:

a gusset orifice in said gusset means;

a peripheral orifice in said enclosure near the periphery of said enclosure; and wall means forming a seal between the periphery of said gusset orifice and the periphery of said peripheral orifice.

8. The inflatable wall of claim 7 further including:

an electrical display in said window; and a electrical cord disposed through said raceway and connected to said electrical display for powering said display.

9. The inflatable wall of claim 1:

said hinge means comprising:

a plurality of loops of flexible material.

10. An inflatable structure comprising:

a plurality of walls; each wall comprising:

a wall panel including:

a pliable skin defining an inflatable enclosure; said skin including:

a first sheet generally defining a first side of said enclosure; said first sheet having an inner side and an outer side; and a second sheet generally defining a second side of said enclosure; said second sheet having an inner side and an outer side;

internal web means within said enclosure joining said inner side of said first sheet to said inner side of said second sheet such that, when said enclosure is inflated, said first sheet and said second sheet are substantially parallel spaced vertical planes, said enclosure has a periphery and said wall panel has a periphery including a bottom for placement on a support surface, a top and first and second ends; and hinge means attached to said wall first end; said hinge means having a vertical axis; said hinge means for hinged attachment to mating vertical hinge means on an adjacent wall for supporting said wall structure in an upright position.

11. The inflatable structure of claim 10:

said adjacent wall attached at an angle.

12. An inflatable structure comprising:

a pair of walls; each wall comprising:

a wall panel including:

a pliable skin defining an inflatable enclosure; said skin including:

a first sheet generally defining a first side of said enclosure; said first sheet having an inner side and an outer side; and a second sheet generally defining a second side of said enclosure; said second sheet having an inner side and an outer side; and internal web means within said enclosure joining said inner side of said first sheet to said inner side of said second sheet such that, when said enclosure is inflated, said first sheet and said second sheet are substantially parallel spaced vertical planes, said enclosure has a periphery and said wall panel has a periphery including a bottom for placement on a support surface, a top and first and second ends; and hinge means having a vertical axis; said hinge means of flexible material hingedly attaching said first ends of said walls such that said walls may be positioned non-linearly to one another so as to support one another to form a wall having a front and a rear.

13. The inflatable structure of claim 12: further including:

supplemental hinge means connected to said wall panels adjacent said hinge means; said supplemental hinge means having a vertical axis; said supplemental hinge mean for hinged attachment of another wall.

14. The inflatable structure of claim 12: further including:

a pair of supplemental hinge means; said supplemental hinge means connected to said wall panels adjacent said hinge means, one on said front and one on said rear; each said supplemental hinge means for hinged attachment of another wall.

15. The inflatable wall of claim 1:

said enclosure including:

a potential display window comprising:

a potential window area on said first sheet;

a potential window area on said second sheet;

gusset means forming a seal between the periphery of said window area on said inner side of said first sheet and the periphery of said window area on said inner side of said second sheet.

* * * * *